United States Patent [19]

Clark

[11] Patent Number: 4,854,094

[45] Date of Patent: Aug. 8, 1989

[54] METHOD FOR CONVERTING ONE OR MORE STEEL SHIPPING CONTAINERS INTO A HABITABLE BUILDING AT A BUILDING SITE AND THE PRODUCT THEREOF

[76] Inventor: Phillip C. Clark, 10245 SW. 124th Ave., Miami, Fla. 33186

[21] Appl. No.: 123,885

[22] Filed: Nov. 23, 1987

[51] Int. Cl.[4] ..... E04H 5/06

[52] U.S. Cl. ..... 52/79.1; 52/79.7; 52/79.9; 52/234; 52/741; 52/DIG. 9

[58] Field of Search ..... 52/79.1, 79.5, 79.9, 52/DIG. 9, 234, 79.7, 741-745

[56] References Cited

U.S. PATENT DOCUMENTS

| | | | |
|---|---|---|---|
| 3,182,424 | 5/1965 | Betjemann | 52/234 |
| 4,467,573 | 8/1984 | Langerbeck | 52/79.1 X |
| 4,644,708 | 2/1987 | Baudot et al. | 52/79.9 |

FOREIGN PATENT DOCUMENTS

| | | | |
|---|---|---|---|
| 2519841 | 11/1975 | Fed. Rep. of Germany | 52/79.5 |
| 1953109 | 8/1978 | Fed. Rep. of Germany | 52/79.1 |
| 2441703 | 7/1980 | France | 52/79.1 |

*Primary Examiner*—David A. Scherbel
*Assistant Examiner*—Richard E. Chilcot, Jr.
*Attorney, Agent, or Firm*—John H. Faro

[57] ABSTRACT

Method comprises mounting at least one standard steel shipping container on a weight-bearing foundation at the ends thereof. Where two or more containers are used, the containers may be in spaced and/or abutting side-by-side relationship; and/or may be mounted one upon another. Where containers are mounted side-by-side, portions of the inner sidewalls are removed leaving at least narrow flanges extending inwardly from the edges thereof. A roof is installed over the top walls of the containers; a raised floor is installed over the bottom walls of the containers enclosing flanges that extend inwardly from the bottom walls; and a dropped ceiling is installed under the top walls of the containers enclosing flanges that extend inwardly from the top walls. At least one window opening and one door opening are provided in the side and end walls, and a window and a door are installed therein. The invention includes the novel product of the method.

11 Claims, 4 Drawing Sheets

FIG.6
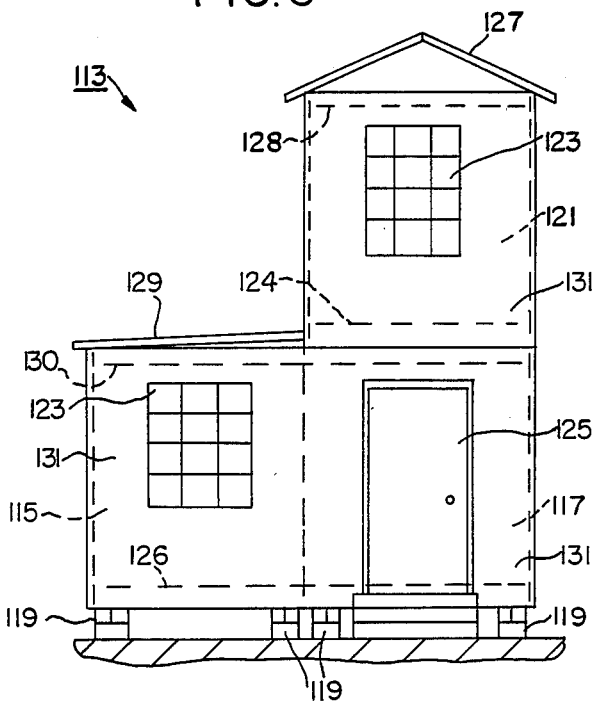
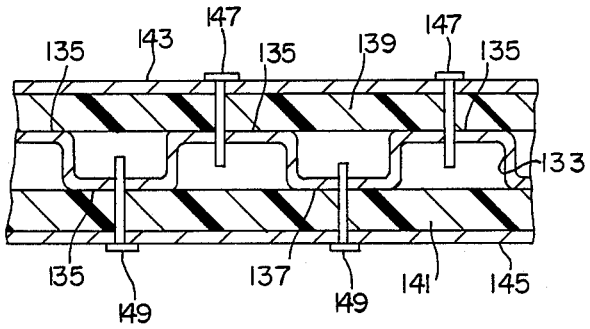
FIG.7

METHOD FOR CONVERTING ONE OR MORE STEEL SHIPPING CONTAINERS INTO A HABITABLE BUILDING AT A BUILDING SITE AND THE PRODUCT THEREOF

BACKGROUND OF THE INVENTION

1. Field of the Invention

This invention relates to a novel method for converting one or more steel shipping containers to a habitable building. The novel method is carried out at the site where the building is to be used. The invention includes also the novel building produced by the novel method.

2. Description of the Prior Art

Much freight is now shipped overseas in containers of standard sizes; usually eight and one half (8½) feet high, eight (8) feet wide and twenty (20) or forty (40) feet long. Marine freight is transported in steel containers that have a box-like frame of steel members, a bottom wall of steel channel beams attached to the frame and wood slats wedged therebetween, a top wall, two opposed sidewalls of corrugated steel sheets welded to the frame, and two opposed steel end walls connected to the frame, one end wall of which includes two outwardly swinging steel doors. Each corner of the frame includes a special metal fitting adapted to pass a steel cable therethrough. These fittings are used for lifting and lowering the container and for anchoring the containers to one another to prevent shifting and toppling in their transport vehicle.

These steel containers are very strong. However, after considerable use, they become uneconomical to use as shipping containers and they are taken out of service. The present invention seeks to use the residual characteristics of such used steel containers to produce habitable buildings economically.

It is known to prefabricate entire buildings and also to prefabricate substantial portions of buildings which are then assembled on the site where these buildings are to be used; as described, for example, in U.S. Pat. No. 4,075,814 to J. Theurer et al. Some prefabricated buildings are packaged at the factory in units that are similar in size to standard shipping containers; as described, for example, in U.S. Pat. Nos. 3,540,173 to S. Johnides; 3,792,558 to J. Berce et al; and 4,299,065 to J. M. Fairgrieve.

Prefabrication of buildings offers some advantages over on-site fabrication of new custom buildings, but the buildings are nevertheless expensive. The novel method does not involve prefabrication, although it enjoys some of the advantages attributed to prefabrication. The novel method takes advantage of the steel shipping containers that have been taken out of service and which can be converted at the building site to strong structural shells for buildings at low initial costs.

It is also known to convert shipping crates and tractor trailers into both temporary or permanent housing. The buildings produced by such conversions are relatively flimsy, flammable and relatively unsafe to be in. Conversions to such buildings are possible because of the light, structurally-weak character of the initial containers. The novel method converts standard steel shipping containers, which are structurally strong, and are not easily or obviously converted to safe, habitable buildings.

OBJECTS OF THE INVENTION

An object of this invention is to provide a novel method for converting one or more standard steel shipping containers into a habitable building.

Another object is to provide a method of the type described including the necessary steps for effecting such conversion.

A further object is to provide a method of the type described which is particularly adapted to be practiced at the site where the building is to be used. A further object is to provide a method of the type described using steel shipping containers that have been used and taken out of service.

Another object is to provide a novel habitable building having, as its shell, one or more modified standard steel shipping containers.

Another object is to provide a habitable building having a novel construction and design.

A still further object is to provide a novel prepared by the novel method.

SUMMARY OF THE INVENTION

The above and related objects of this invention are achieved with the novel on-site method for converting one or more standard steel shipping containers into a habitable building. The novel method comprises mounting at least one such container on a weight-bearing foundation at the ends thereof. Where two or more containers are used, the containers may be in spaced and/or abutting side-by-side relationship; and/or may be mounted one upon another. Where containers are mounted side-by-side, portions of the inner sidewalls are removed leaving at least narrow flanges extending inwardly from the edges thereof so as to retain most of the strength and rigidity of the containers. Openings are made in the outer sidewalls and the end walls for at least one window and one door, leaving at least a narrow inwardly-extending flange from the edges of the walls. A roof is installed over the top walls of the containers. A raised floor is installed over the bottom walls of the containers, which floor encloses any flanges extending inwardly from the bottom walls. A dropped ceiling is installed below the top walls of the containers, which ceiling encloses any flanges extending inwardly from the top walls. A window is installed in the window opening and a door is installed in the door opening.

The novel method takes advantage of the corrugated form of the sidewalls and endwalls of the steel containers so that they are treated in some respects as if they are stud walls as in residential frame house construction. The building may be further improved with the installation of thermal insulation, decorative inside walls, weather-resistant exterior covering, plumbing, electrical service, lighting, interior stud walls, etc. by novel steps that take advantage of the corrugated construction of the container walls, and/or by methods normally used in commercial and/or residential construction.

The novel method thereby uses the residual characteristics of out-of-service steel shipping containers, which containers are available all over the world at low cost. All of the materials needed in addition to the containers for the novel building may be placed within the containers to be modified and then be delivered to the building site. Thus, complete kits can be provided at minimal extra cost to the converter, and a reduced amount of building scrap is generated since the shipping container itself becomes part of the building. Of course, more than two containers may be joined in a horizontal array and, one or more containers may be stacked on top of the above-described array to produce any of various arrangements for a second level in the building. Also, another level of containers may be partially below ground level to provide a cellar for the building.

BRIEF DESCRIPTION OF THE DRAWINGS

FIG. 6 is a front elevational view of a fourth embodiment of a novel building prepared by the novel method with one steel container mounted on top of one of two other steel container which are in abutting, side-by-side relationship.

FIG. 7 is a sectional view through a fragment of a sidewall of a novel building showing one form of construction employing thermal insulation, a decorative inner layer and a weather-resistant outer layer.

DETAILED DESCRIPTION OF THE INVENTION INCLUDING THE PREFERRED EMBODIMENTS

Figure 1:
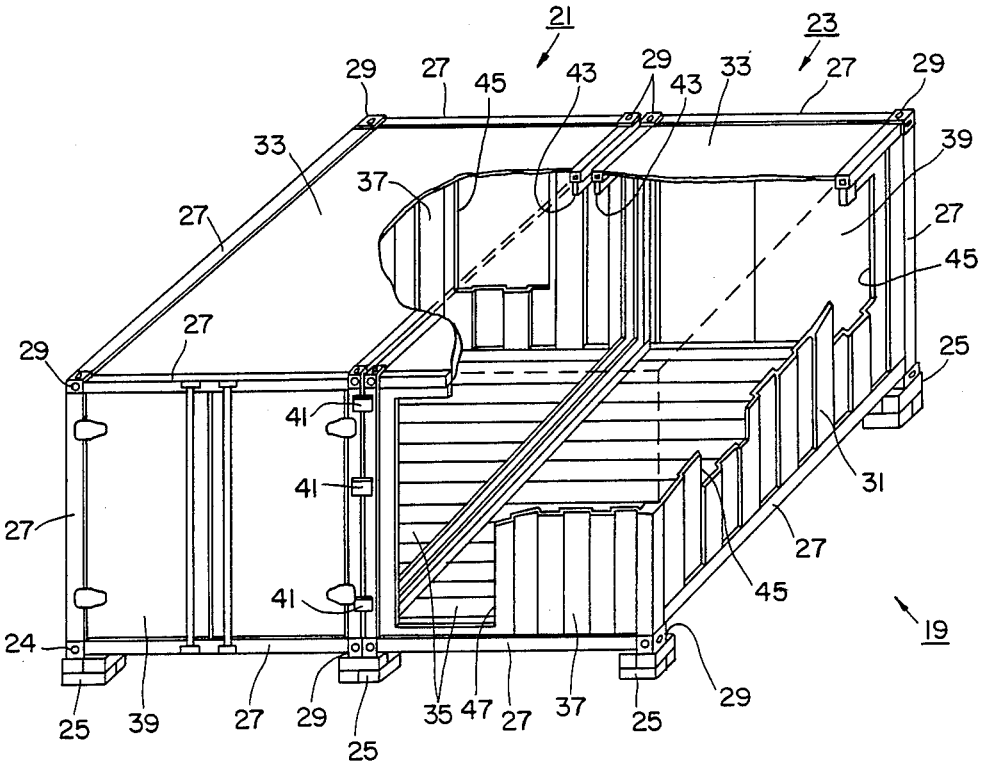
FIG. 1 is a broken-away perspective view of a first embodiment of a novel building at an intermediate stage of construction by the novel method with two steel containers in abutting, side-by-side relationship.

The following description of some of the preferred embodiments of the concepts of this invention is made in reference to the accompanying figures. Where an individual structural element is depicted in more than one figure, it is assigned a common reference numeral for simplification of identification and understanding.

The novel method employs one or more standard steel shipping containers as a starting point for producing a structurally strong shell for a building. As pointed out above, such containers which have been taken out of service are used in the novel method, although new, unused containers can also be used. Steel shipping containers are available in standard sizes, all of which are about eight (8) feet wide, eight and one half (8½) feet high and different unit lengths including twenty (20) foot lengths and forty (40) foot lengths. They are of a welded steel construction for strength and to prevent pilferage. The containers are "standard" because they conform in size and construction to ISO or similar standards. Containers of any standard size may be used in the novel method and, for any particular building, the containers may all be the same size or may be different sizes.

Referring to FIG. 1, each container (21) and (23) includes a steel frame comprising a plurality of steel beams (27) welded together to form a rectangular parallelapiped. Each corner of the container has a metal fitting (29) with three connected holes in their outer faces, which fitting is adapted for stringing cables or ropes therethrough. These fittings may be used for anchoring the containers to one another and/or to the foundation. Where each container is mounted, it is mounted on its corner fittings so that the weight of the container and its contents is distributed in its steel frame.

Each container (21) and (23) includes (i) two opposed sidewalls (31) of corrugated steel sheet that is welded along its edges to the frame; (ii) a top wall (33) of light steel sheet welded around its edges to the frame; (iii) a bottom wall (35) of steel channel cross members with wood planks wedged therebetween and (iv) two opposed end walls, one endwall (37) being of corrugated steel welded along its edges to the frame and the other endwall comprising a double steel door (39) hinged at its edges to the frame.

EXAMPLE 1

FIG. 1 illustrates the shell (19) for a building comprising two modified steel containers mounted on weight-bearing foundations in adjacent, abutting side-by-side relationship. To prepare this shell, two standard steel twenty (20) foot containers (21) and (23) are first mounted on concrete-block footers (25) at the corners thereof in an adjacent, abutting side-by-side relationship. After the containers (21) and (23) have been mounted on the footers (25), they are welded together at their end walls with steel straps (41). Instead of welding, the two containers (21) and (23) may be joined together with bolts through their adjacent inner sidewalls. Substantially all of the adjacent inner sidewalls (31) are removed by cutting, as with an acetylene torch, except for narrow flanges (43) about four (4) to eight (8) inches long extending inwardly from the edges of the sidewalls and frame. It is advisable to retain these flanges (43) in order to retain an optimum amount of strength in the central frame members (27) of the building.

Window openings (45) and a door opening (47) are cut in the corrugated steel sheet of the endwalls (37) and the sidewalls (31). As described above, at least a narrow flange about four (4) to eight (8) inches long if left below the door opening (47) and above the door and window openings (45). The container doors in the endwalls (39) are closed and clamped, bolted or welded shut. FIG. 1 shows the novel building at the point in construction where the containers (21) and (23) have been positioned on weight-bearing foundations and modified to form the shell of the building, but nothing has been added to the shell.

Figure 2:
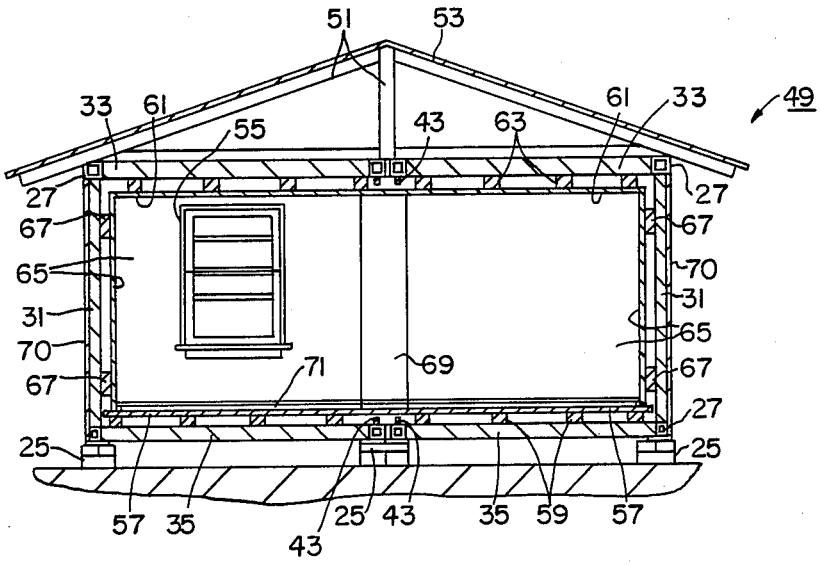
FIG. 2 is a sectional elevational view of a portion of the novel building shown in FIG. 1 after completion by the novel method.

As shown in FIG. 2, various materials are added to the shell to complete the building (49). These additions adapt the building for its intended purpose and make the building more habitable. Generally, the installations of the various materials follow the usual practices in the construction of frame houses and of commercial buildings. However, some new methods may take advantage of or adapt to the character of the shell.

Roof trusses (51) are attached to the frame over the top walls (33) and a roof (53) of sheet plywood, asphalt-impregnated paper, and roofing shingles are installed thereon. Of course, other roof designs maybe used. After the roof is (53) installed, electrical service, plumbing, and other services are installed. Because of the corrugated character of the sidewalls (31) and endwalls (37), the pipes, wires and fixtures of the various services may be installed in the corrugations of these walls.

Windows and window frames (55) are installed in the window openings (45) shown in FIG. 1. A door and a door frame (not shown) is installed in the door opening (47) shown in FIG. 1. A raised floor (57) is installed over the bottom walls (35) using wood spacers (59) in such manner as to enclose the flanges (43) extending inwardly from the bottom wall (35). A dropped ceiling (61) is installed under the top walls (33) using spacers (63) in such manner as to enclose the flanges (43) which extend inwardly from the top wall (33). Steps or a ramp (not shown) installed outside the building from ground level to each outside door.

Optionally, stud walls (not shown) may be installed within the building (49) to divide the floor space therein into two or more rooms. Interior finished walls (65) are constructed on the sidewalls (31) and end walls (37) and (39) using spacers (67), and also on interior stud walls if present. Where the flanges (43) protrude, they may be enclosed with a box (69) carrying the interior finish. A baseboard (71) may also be installed. The outer surfaces of the building are covered with a layer of foam insulation and a layer of weather-resistant material (70) as described below with respect to FIG. 7.

Various appliances, such as a water-heater, a space heater, an airconditioner, a range, an over, a dish washer, a clothes washer, a clothes dryer, etc. maybe installed in the same way as they are commonly installed in other buildings. In fact, an advantage of the novel building is that it can be completed using methods that are compatible with or identical with current building practice. Yet the shell can be produced on-site by the novel modification of two or more out-of-service standard steel shipping containers.

EXAMPLE 2

Figure 3:
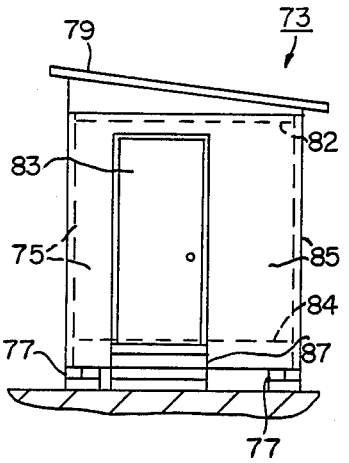
FIGS. 3 and 4 are, respectively, front and side elevational views of a second embodiment of a novel building prepared with only one steel container by the novel method.
Figure 4:
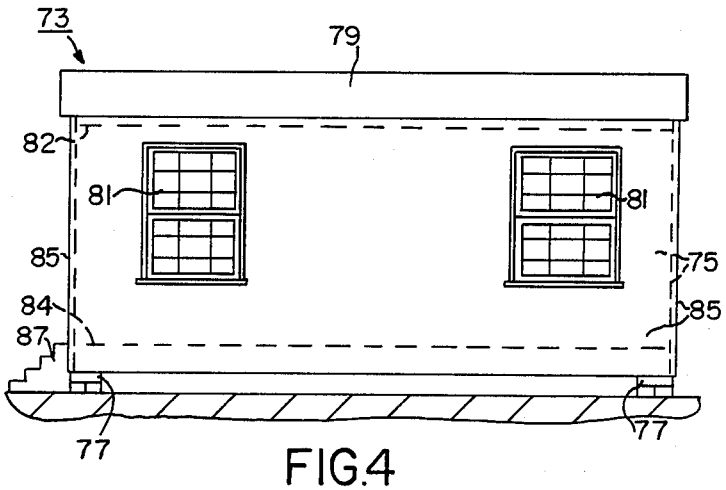

The novel method may be used to prepare a novel habitable building (73) from only one steel shipping container (75) as exemplified by the second embodiment shown in FIGS. 3 and 4. Fabrication of the novel building (73) follows the procedure described in Example 1, except that only one container is used and, therefore, the steps of joining two containers together and removing facing portions of adjacent inner sidewalls is unnecessary. The single container (75) is mounted at the ends thereof on concrete block footers (77) or other weight-bearing foundation. A roof (79) is installed over the topwall of the container (75). Window openings and a door opening are cut out of the steel sidewalls and endwalls of the container (75). Then, windows (81) and a door (83) are installed in these openings. A dropped ceiling (82) and a raised floor (84) are installed inside the container as described in Example 1. A layer of outside thermal insulation is installed adjacent the outside surfaces of the container (75), and then a weather-resistant layer (85) is installed on the outside insulation layer as shown in FIG. 7. A layer of inside thermal insulation (not shown) is installed adjacent the inside surfaces of the sidewalls and endwalls of the container (75) and then a decorative layer is installed on the inside insulation layer, as shown in FIG. 7. Outside steps (87) leading up to the door (83) are also provided. As in Example 1, inside partitions, doors, closets and various services and appliances are installed inside the shell as desired.

EXAMPLE 3

Figure 5:
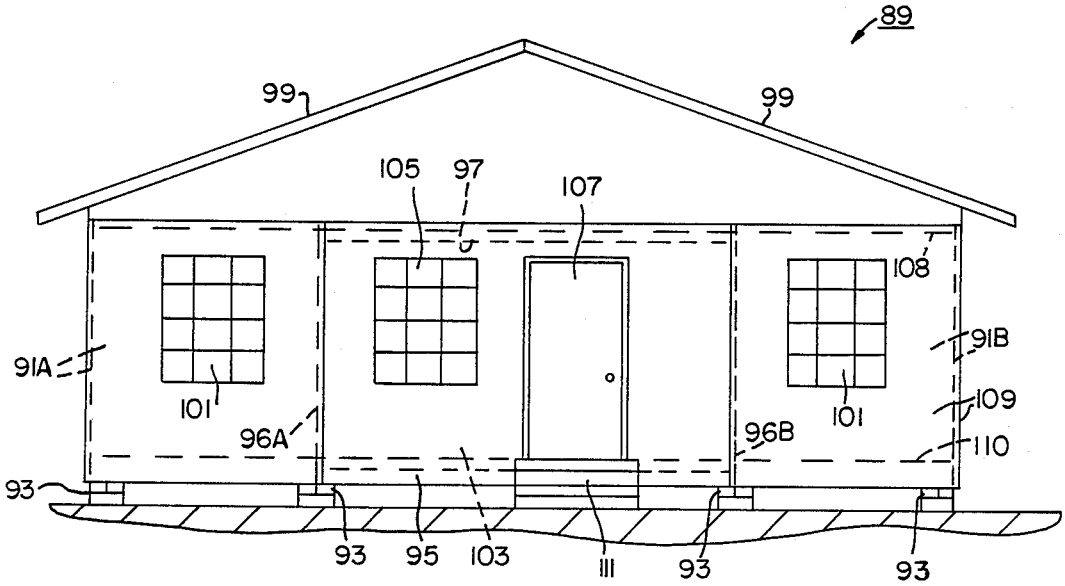
FIG. 5 is a front elevational view of a third embodiment of a novel building prepared by the novel method with two steel containers in spaced, side-by-side relationship.

The novel method may be used to prepare a novel habitable building (89) from two steel shipping containers (91A) and (91B) that are mounted in spaced-apart side-by-side relationship, as exemplified by the third embodiment shown in FIG. 5. Fabrication of the novel building (89) follows the procedure described in Example 1, except that the containers (91) are spaced apart, the space therebetween is enclosed, and access means are provided between the enclosed space and each of the containers. The steps of joining the two containers and removing facing portions of adjacent inner sidewalls described in Example 1 is unnecessary.

In the third embodiment shown in FIG. 5, each container (91A) and (91B) is mounted at the ends thereof on concrete-block footers (93) or other weight-bearing foundations. The distance between the containers (91A) and (91B) can be any desired amount. In this example, the containers are spaced apart about ten (10) feet. A subframe (95) comprising metal or wood headers and joists are assembled on top of the footers (93) that are under the inside sidewalls (96A) and (96B) of the containers (91A) and (91B). Spacer beams (97) are attached at the upper edges of the inside sidewalls (96A) and (96B) bridging the space therebetween to complete the frame of the shell and to maintain the containers in proper relationship to one another.

A common roof (99) including roof trusses (not shown) is installed over the topwalls of the containers (91A) and (91B) and the space therebetween. Window openings and a door opening may be cut out of the steel sidewalls and endwalls of the containers (91A) and (91B). Then windows (101) and a door (not shown) may be installed in these openings. A stud wall (103) is constructed at each end of the space between the containers (91A) and (91B) to complete the closure of said space. The stud walls (103) may include windows (105) and a door (107). The space defined by the subframe (95), the roof (99) and the stud walls (103) becomes living space which, because of its construction, increases living space without adding to the number of steel containers that are required. Access openings (not shown) are cut out of the inside sidewalls (96A) and (96B) to provide access between the enclosed space and each of the containers.

As in Example 1, a dropped ceiling (108) and a raised floor (110) are installed inside the containers (91A) and (91B) and in the space therebetween. A layer of outside thermal insulation is installed against the outside surfaces of the shell, and then a weather-resistant layer (109) is installed thereon (see FIG. 7.). A layer of inside thermal insulation is installed against the inside surfaces of the shell, and then a decorative layer (see FIG. 7) is installed thereon. Outside steps (111) leading up to the door (107) are also provided. As in Example 1, inside partitions, doors, closets and various services and appliances are installed inside the shell as desired.

EXAMPLE 4

The novel method may be used to prepare a novel habitable building (113) by placing one or more shipping containers on top of one or more containers at ground level. In the fourth embodiment shown in FIG. 6, two steel shipping containers (115) and (117) are mounted in concrete-block foundations (119) in abutting, side-by-side relationship, similar to the arrangements shown in FIG. 1. Then, a third steel shipping container (121) is mounted on top of and in alignment with one of the steel shipping containers (117), with the corner blocks of the upper container (121) on the corner blocks of the lower container (117). The containers (115), (117) and (121) are then connected together as by welding, strapping or bolting or any other method which will retain the physical relationship among them. Portions of the sidewalls and endwalls of the three containers are removed to provide access between the lower containers (115) and (117), and to provide window and door openings in all three containers. In addition, a portion of the top wall of the one lower container (117) and also the opposite portion of the bottom wall of the upper container (121) is removed to provide an opening for a stair (not shown).

As in the foregoing examples, windows (123) and doors (125) are installed in the window and door openings and a stair (not shown) is installed in the stair opening between the raised floor (124) of the upper container (121) and the raised floor (126) of the one lower container (117). A roof (127) is installed over the upper container (121). A deck (129) (or another roof in the alternative) is installed over the other lower container (115). Dropped ceilings (128) and (130), and raised floors (124) and (126), are installed in lower and upper containers. Inside and outside insulation layers are installed on inside and outside surfaces of the containers as described below with respect to FIG. 7. A weather-resistant layer (131) is installed on the outside insulation layer and a decorative layer is installed on the inside insulation layer (see FIG. 7). As in Example 1, inside partitions, doors, closets and various services and appliances are installed as desired.

FIG. 7 shows one construction of an outside wall for any of the foregoing embodiments, which construction is simple, is effective for making the building habitable, and can be assembled with low labor cost. The corrugated steel wall (133) is cleaned and a temporary adhesive is applied to the outside and inside raised surfaces (135) and (137). Then, outside and inside plastic foam sheets (139) and (141) respectively of thermal insulation are pressed against and adhered to the raised surfaces (135) and (137) respectively. Sheets of weather-resistant material (143) are held against the outside insulation layer (139) while holes are drilled through the outside layers (143) and, (139) and the outside raised portions (135); and connectors (147) are attached to the outside raised portion (135). Similarly, sheets of decorative inside material (145) are held against the inside insulation layer (141) while holes are drilled through the inside layers (145) and, (141) and the inside raised portions (137); and connectors (149) are attached to the inside raised portions (137). The decorative layer is preferably wood panels or sheet-rock panels. This construction reduces heat transfer through the walls to improve habitability in both hot and cold environments. In some constructions, it may be desirable to include a vapor barrier adjacent the outer insulation layer.

In addition to mounting steel containers as described in the example, one or more containers may be mounted with one end partially in the ground. For instance, Example 4 may be modified so that one ends of the lower containers (117) and (119) are mounted as shown and the other far end of the lower containers are mounted in the ground so that the far end (not shown) of the upper container (121) has direct access to ground level by way of another short set of steps.

In still other arrangements; one or more steel containers may be mounted in the ground under and in alignment with the ground level steel containers to thereby provide a cellar for the building. This arrangement is particularly practical in dry climates with well drained soil.

It is noteworthy that the novel building is expandable. For instance, another steel container can be added to an existing novel building in abutting or in spaced, side-by-side relationship in the manner described above. In another instance, another steel container may be added on top of the container of an existing building provided the foundation is strong enough.

As pointed out above, the containers can be used to ship to the building site the additional parts for upgrading the building. Additional space in the container can be used to ship other, unrelated goods, thereby reducing the cost of the container to the builder. Also, where several novel buildings are to be built at the same location, one or more containers can be used temporarily as the builders office and/or warehouse for parts while the novel buildings are being built.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A habitable building comprising at least two steel shipping containers, each of said containers including a box-like frame of steel members, a bottom wall and a top wall connected to said frame, two opposed sidewalls of corrugated steel sheet welded to said frame, and two opposed steel endwalls connected to said frame, said containers being mounted on weight-bearing foundations located under said endwalls and being joined together in adjacent, side-by-side relationship, the adjacent inner sidewalls of said containers having portions thereof removed leaving at least a narrow flange extending inwardly from the edges thereof, said removed portions providing access between said containers, a roof over and attached to the top walls of said containers, a common raised floor over and attached to the bottom walls of said containers, said floor enclosing the flanges extending inwardly from said bottom walls, at least one window and at least one door in the walls of said containers.

2. The building defined in claim 1 wherein substantially all of the inner adjacent sidewalls are removed except for a pair of narrow adjacent flanges extending inwardly from said bottom, end and top walls of said containers.

3. The building defined in claim 2 including a common dropped ceiling under and attached to said top walls, said ceiling enclosing the inwardly extending flanges from said top walls.

4. The building defined in claim 3 including finished inside walls attached to the inner surfaces of said outer sidewalls and said endwalls, said finished inside walls including means boxing in the flanges extending inwardly from said endwalls.

5. The building defined in claim 4 including finished outside walls attached to the outside surfaces of said outer sidewalls and said endwalls, said outside walls including an insulating layer adjacent said outside surfaces, a weather-resistant layer adjacent said insulating layer, and means holding said weather-resistant layer to said container walls.

6. The method for converting at least two, steel shipping containers into a habitable building, each of said containers including a box-like frame of steel members, a bottom wall and a top wall connected to said frame, two opposed steel sidewalls of corrugated steel sheets welded to said frame, and two opposed endwalls connected to said frame, said method comprising:

A. mounting said at least two containers on weight-bearing foundations located under said endwalls in adjacent, side-by-side relationship, joining said containers together, and then carrying out the following steps:

B. removing facing portions of the adjacent inner sidewalls leaving at least narrow flanges extending inwardly from the edges thereof, C. installing a roof over the top walls of said containers, D. installing a common raised floor over the bottom walls of said containers, said floor enclosing the flanges extending inwardly from said bottom walls, E. providing at least one window opening and at least one door opening in the walls of said containers, and F. installing a window in said window opening and a door in said door opening.

7. The method defined in claim 6 including, prior to step A, the steps comprising (i) loading parts to be installed in said building into at least one of said containers, (ii) and then transporting said containers to the site where said building is desired.

8. The method defined in claim 6 wherein, at step. B, substantially all of the inner adjacent sidewalls are removed except for a pair of narrow flanges extending inwardly from said bottom, and top walls of said containers.

9. The method defined in claim 8 including installing a dropped ceiling under said top wall, said ceiling enclosing the inwardly-extending flanges from said top walls.

10. The method defined in claim 9 including installing finished inside walls on the inside surfaces of said outer sidewalls and said end walls, said inside walls boxing in the flanges extending inwardly from said endwalls.

11. The method defined in claim 10 including installing finished exterior coverings on outside surfaces of said outer steel sidewalls and endwalls, said method including adhering a layer of foam insulation to said outside surfaces, positioning a weather-resistant layer on said insulation layer, and then fastening said weather-resistant layer to said steel sidewalls and steel endwalls with said insulation layer therebetween.

* * * * *